US005938549A

United States Patent [19]

Schenkenfelder

[11] Patent Number: 5,938,549

[45] Date of Patent: Aug. 17, 1999

[54] GAME OF TAG AND APPARATUS USED THEREIN

[76] Inventor: John C. Schenkenfelder, 2333 Village Dr., Louisville, Ky. 40205

[21] Appl. No.: 08/984,715

[22] Filed: Dec. 3, 1997

[51] Int. Cl.[6] ..... A63B 71/02

[52] U.S. Cl. ..... 473/502

[58] Field of Search ..... 473/502

[56] References Cited

U.S. PATENT DOCUMENTS 3,063,718 11/1962 Steinkamp .
3,370,853 2/1968 Feld et al. .
4,330,120 5/1982 Netti .
4,653,582 3/1987 Ehrenfried .
4,691,924 9/1987 Strong .
4,718,677 1/1988 Barnes .
4,765,748 8/1988 Fidalgo .
4,971,334 11/1990 Stewart .
4,986,548 1/1991 Conner .
5,139,273 8/1992 Rudell et al. .
5,335,916 8/1994 Nee .
5,443,576 8/1995 Hauter .
5,484,156 1/1996 Giguere .

*Primary Examiner*—William H. Grieb
*Attorney, Agent, or Firm*—Middleton & Reutlinger; Daniel C. Stelter

[57] ABSTRACT

A game of tag providing the steps of providing a plurality of players, placing at least one band on a limb of each of the plurality of players, attaching at least one flag to the at least one band, each of the plurality of players attempting to remove the at least one flag from the at least one band of at least one of the plurality of players.

2 Claims, 2 Drawing Sheets

GAME OF TAG AND APPARATUS USED THEREIN

BACKGROUND OF THE INVENTION

1. Technical Field of the Invention

The present invention relates to games of tag and to apparatuses used therein. More particularly, the present invention relates to a game of tag, wherein a player thereof is provided with at least one band worn on one of the player's limbs and to which a flag is detachably secured thereto for removal therefrom by an opponent of the player.

2. Description of the Related Art

Games of tag, and games of the like, are well-known in the prior art. Typically, a game of tag is played between two or more players, each player being provided with a flag or other indicia to show their participation in the game. Each player, or each team of players, attempts to gather the flag of an opposing player, or of all players of an opposing team. Game play continues until one player, or one team of players, collects all the flags of all other players, or of all players of all opposing teams. Variations in games of tag, and in apparatuses used therein, are well-known. For example, U.S. Pat. No. 3,063,718 to Steinkamp teaches a detachable streamer means for use in playing touch football.

BRIEF SUMMARY OF THE INVENTION

The present invention is for a game of tag between two or more players, or between two or more teams of players, wherein each player is provided with a band removably attached to one of the player's limbs, such as, for example, a player's wrist, arm, leg or ankle, and to which at least one flag is detachably secured thereto for removal therefrom by an opponent of the player. It is therefore an object of the present invention to provide a game of tag, and an apparatus used therein, between two or more players, wherein each player is provided with a band worn on one of the player's limbs and to which a flag is detachably secured thereto for removal therefrom by an opponent of the player.

A game of tag according to the present invention includes the steps of providing a plurality of players, placing at least one band on a limb of each of the plurality of players, attaching at least one flag to the at least one band, each of the plurality of players attempting to remove the at least one flag from the at least one band of at least one of the plurality of players.

An apparatus for use in a game of tag comprises a band having a belt loop attached to a first end of the band and a first attaching means attached to an opposed second end of the band, the belt loop receiving the second end therethrough, the second end being foldable over the belt loop and being removably attachable to second attaching means provided on a first side of the band; and, at least one flag having flag attaching means at one end thereof, the flag attaching means being detachably secured to the second attaching means of the band.

BRIEF DESCRIPTION OF THE SEVERAL VIEWS OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
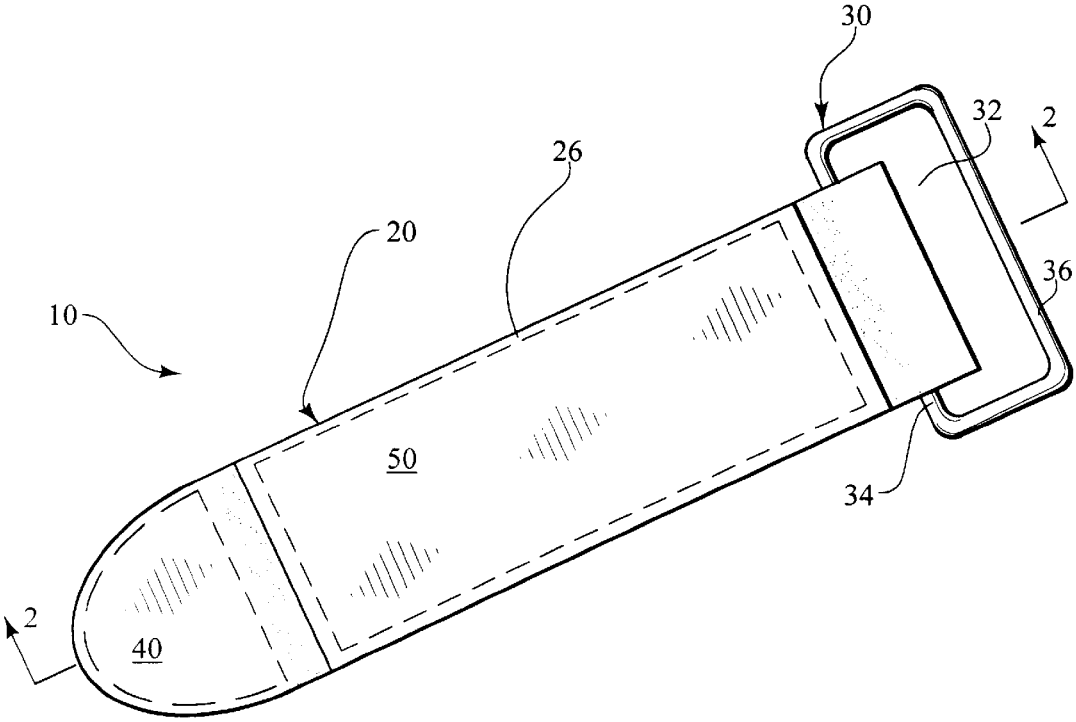
FIG. 1 is a top view of an apparatus for use in a game of tag according to a preferred embodiment of the present invention.
Figure 2:
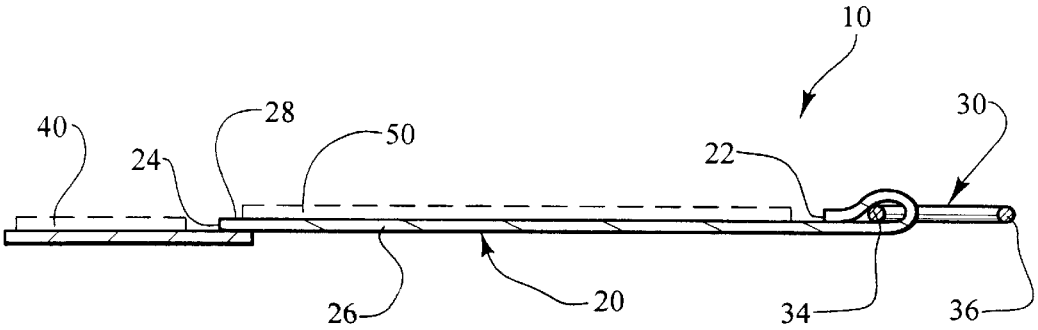
FIG. 2 is a sectional view of the apparatus of FIG. 1, taken along section line 2—2 of FIG. 1 with selected portions shown in phantom lines; and, FIG. 3 is a perspective view of the apparatus of FIG. 1, shown with a flag detachably secured thereto.
Figure 3:
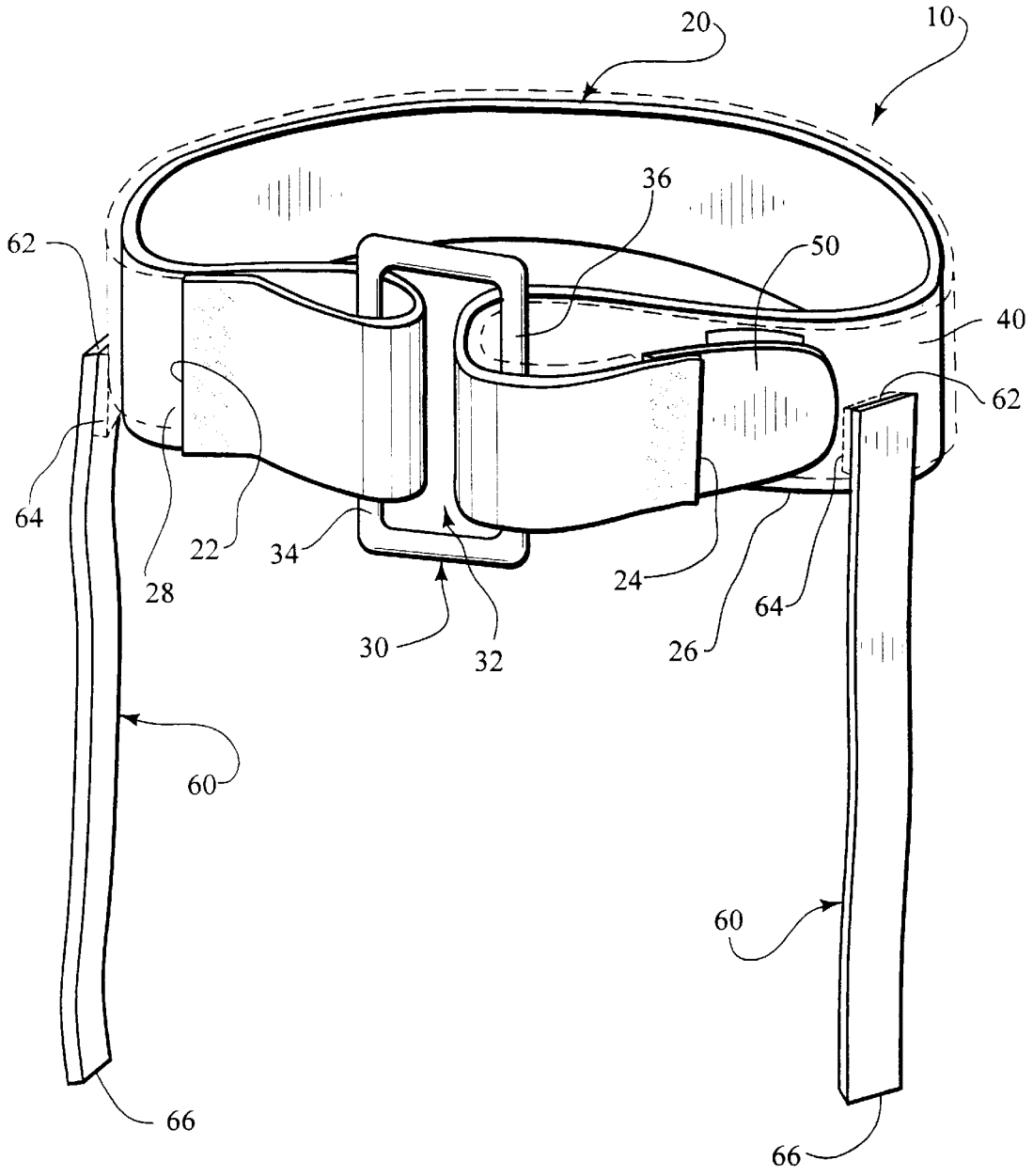

With reference to the Figures, a band 10 according to a preferred embodiment of the present invention includes a flexible strap member 20 having first and second ends 22, 24, respectively, and a center portion 26 therebetween. A belt loop 30 is attached to the strap member 20 towards the first end 22 thereof, such as, for example, by folding the first end 22 of the strap member 20 through a strap-receiving opening 32 in the belt loop 30, around a first longitudinal arm 34 thereof, and over a first side 28 of the center portion 26 of the strap member 20. The first end 22 of the strap member 20 is fixedly attached to the first side 28 of the center portion 26 of the strap member 28 by any suitable means, such as, for example, by stitching, thermo-setting, or the like.

A first attaching means 40 is attached to the second end 24 of the strap member 20, such as, for example, by stitching or thermo-setting, and is constructed from one component, such as, for example, a hook component of a cooperating hook-and-loop-type fastener. Alternatively, the hook-and-loop-type fastener may be replaced with any similar, suitable attaching means, such as, for example, an adhesive-coated sheet.

A second attaching means 50 is attached to the first side 28 of the center portion 26 of the strap member and is constructed from one component, such as, for example, a loop component of a cooperating hook-and-loop-type fastener, which cooperates with the first attaching means 40 to detachably secure the first attaching means 40 thereto. Alternatively, the hook-and-loop-type fastener may be replaced with any similar, suitable means, such as, for example, an adhesive-coated sheet.

The band 10 is removably attached to a limb of a player, such as, for example, around an arm, wrist, leg or ankle thereof. The strap member 20 is wrapped around the player's limb such that the first side 28 of the strap member 20 faces outwardly therefrom. The second end 24 of the strap member 20 is inserted through the strap-receiving opening 32, around a second longitudinal arm 36 thereof, and over a first side 28 of the center portion 26 of the strap member 20. The second attaching means 50 provided on the second end 24 of the strap member 20 is detachably secured to the first attaching means 40 provided on the first side 28 of the center portion 26, thereby detachably securing the band 10 to the player's limb.

At least one flag 60 for use with the band 10 includes a first end 62 having flag attaching means 64 attached thereto. The flag attaching means 64 is similar in design to the second attaching means 50 insofar as the flag attaching means 64 is adapted to detachably secure the first end 62 of the flag 60 to the first attaching means 40 provided on the first side 28 of the center portion 26 of the strap member 20 in the same manner as the second attaching means 50 is adapted to detachably secure the second end 24 of the strap member 20 to the first attaching means 40 provided on the first side 28 of the center portion 26 of the strap member 20.

At least one flag 60 is detachably secured to the center portion 26 of the strap member 20 either before or after the band 10 has been attached to a limb of the player. The flag 60 includes a second end 66 opposite the first end 62 which is permitted to hang loosely from the strap member 20. The band 10, strap member 20 and flag 60 may each be constructed from a flexible material having a variety of colors. In this manner, identification of players, and more particularly, of players associated with opposing teams, may be readily made.

A game of tag is played using the band 10 described hereinabove by providing a plurality of players, which may be divided into teams of players for group play. Each player is provided with at least one band 10, which is attached to a limb of the player, such as, for example, a player's wrist, arm, leg or ankle, as described hereinabove. The players may be provided with a plurality of bands 10, all of which may be attached to the same limb of the player, or each of which may be attached to a different limb of the player, or any combination thereof.

At least one flag 60 is detachably secured to the band 10 as described hereinabove for each band 10 attached to the players. The flags 60 may include a color to indicate the particular team, if any, with which each player is associated.

Each player attempts to gather the flags 60 of his/her opponents or teams of opponents before his/her opponents successfully gather his/her own flags 60. Variations in game play and rules associated therewith exist, and are intended to fall within the spirit and scope of the present invention.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

I claim:

1. An apparatus for use in a game of tag, comprising:

a strap member having first and second opposing ends and a center portion disposed between said first and second ends, said center portion having a first side thereof;

a belt loop attached to said first end of said strap member;

first attaching means attached to said strap member towards said second end thereof;

second attaching means attached to said strap member on said first side of said center portion;

at least one flag having flag attaching means at one end thereof, said flag attaching means being detachably secured to said second attaching means of said strap member; and, said belt loop being receivable of said second end of said strap member, said second end being foldable over said belt loop and being removably attachable to said second attaching means.

2. The apparatus according to claim 1, wherein:

said first attaching means is one component of a hook-and-loop-type fastener;

said second attaching means is one component of a hook-and-loop-type fastener; and, said flag attaching means is a cooperating component of said one component of a hook-and-loop-type fastener.

* * * * *